US008466786B2

(12) United States Patent
Haviv

(10) Patent No.: US 8,466,786 B2
(45) Date of Patent: Jun. 18, 2013

(54) LOCKING MECHANISM WITH SABBATH CONTROL UNIT

(75) Inventor: Asher Haviv, Bat-Yam (IL)

(73) Assignee: Rav-Mafteah Ltd., Bat-Yam (IL)

( * ) Notice: Subject to any disclaimer, the term of this patent is extended or adjusted under 35 U.S.C. 154(b) by 338 days.

(21) Appl. No.: 12/856,711

(22) Filed: Aug. 16, 2010

(65) Prior Publication Data

US 2012/0038478 A1 Feb. 16, 2012

(51) Int. Cl.
*G08B 21/00* (2006.01)

(52) U.S. Cl.
USPC ..... 340/540; 340/332; 340/457; 340/542; 340/550; 340/556; 340/557; 70/102; 70/113; 70/149; 49/13; 49/14; 49/31

(58) Field of Classification Search
USPC ..... 340/540, 542, 550, 556, 567, 457, 340/332; 70/102, 113, 149; 49/13, 14, 31
See application file for complete search history.

(56) References Cited

U.S. PATENT DOCUMENTS

| | | | | |
|---|---|---|---|---|
| 2,008,150 | A | 7/1935 | Nelson | |
| 4,058,740 | A | 11/1977 | Dalton et al. | |
| 5,216,406 | A | 6/1993 | Bechtle | |
| 5,680,094 | A * | 10/1997 | Guim et al. | 340/332 |
| 6,078,256 | A | 6/2000 | Gottlieb | |
| 6,703,591 | B2 | 3/2004 | Daum et al. | |
| 7,834,309 | B2 * | 11/2010 | Anderson et al. | 250/221 |
| 2009/0115366 | A1 * | 5/2009 | Mullet et al. | 318/466 |

FOREIGN PATENT DOCUMENTS

| | | |
|---|---|---|
| GB | 2141774 | 1/1985 |
| WO | WO 83/01643 | 5/1983 |
| WO | WO 96/05552 | 2/1996 |

OTHER PUBLICATIONS

Office Action Dated Dec. 14, 2008 From the Israeli Patent Office Re.: Application No. 167530 and Its Translation Into English.
Office Action Dated Sep. 21, 2009 From the Israeli Patent Office Re.: Application No. 167530 and Its Translation Into English.
Response Dated Jul. 20, 2010 to Office Action of Sep. 21, 2009 From the Israeli Patent Office Re.: Application No. 167530.
Bet Halevi "Shabbat Alarm Systems. Halachic Solution for Activiating/Deactivating Your Alarm System on Shabbat", Bet Halevi Systems Ltd., Jan. 29, 2003.
Fairchild "Application Note AN-3010. Using the QVE00033 Surface Mount Phototransistor Optical Interrupter Switch", Fairchild Semiconductor Corporation, 2 P., 2002.

* cited by examiner

*Primary Examiner* — Tai T Nguyen

(57) ABSTRACT

A lock mechanism for locking a door or the like with a Sabbath control unit comprises a Sabbath control unit comprising an optical device including a light beam emitter and detector spaced apart with a line of sight path between them, the optical device operative to provide output indicating if a light beam emitted by the emitter is received by the detector, and a locking mechanism comprising a moving member operative to be displaced between a locked state position wherein the door is locked and an unlocked state position wherein the door is unlocked, wherein the moving member is operative to block the line of sight path while in the locked state position and to clear the line of site path while in the unlocked state position, and wherein the Sabbath control unit is operative to activate an electronic device in response to output indicating that the light beam emitted by the emitter has not been received by the detector.

35 Claims, 9 Drawing Sheets

LOCKING MECHANISM WITH SABBATH CONTROL UNIT

FIELD OF THE INVENTION

The present invention, in some embodiments thereof, relates to a Sabbath control unit for controlling actuation of one or more electrical devices with a door lock mechanism in compliance with Orthodox Jewish custom of no work on the Sabbath and Holy Days and, more particularly, but not exclusively, to a Sabbath control unit for activating and deactivating alarm system or parts thereof.

BACKGROUND OF THE INVENTION

Bolt or latch-actuated switches for controlling room light circuits, and particularly for opening the light circuit in a hotel room when not occupied, have long been known in the art. Known bolt or latch-actuated switches are typically mechanical based switches.

Latch-actuated switches for operating an alarm system is known in automobiles having a central locking system that operates an automobile alarm. U.S. Pat. No. 5,216,406 entitled "Motor vehicle having a central locking system and an anti-theft alarm system," the contents of which is incorporated by reference in its entirety, describes such a motor vehicle. In U.S. Pat. No. 5,216,406 it is described that the locked state and the unlocked state of all locks or doors of the motor vehicle are monitored by means of additional switching contacts. It is disclosed that activating the alarm system is prevented if at least one of the locks is not in the locked state. The switching contacts are common switching contacts that require mechanical contact. Activating the alarm system ready state is nevertheless possible by operating a key-operated lock a certain number of times within a specific limited time period.

According to the practice of orthodox Jews, a Jew may operate an electrical device during the Sabbath and Holy Days. According to this prohibition, an alarm system for securing a premises, e.g. a building or a home that requires deactivation when entering the premises and reactivation upon leaving the premises cannot be operated during the Sabbath and Holy Days. A building or a home is thus left vulnerable when the occupants leave the premises. Optionally, a timer can be preset prior to the onset of the Sabbath and Holy Days to activate and deactivate the alarm system at specific times when the occupants are expected to vacate and occupy the premises respectively. Such an arrangement constrains the occupants from entering the premises during specific hours and also leaves the premises vulnerable when the occupants vacate the premises prior to the time period preset for activating the alarm system.

A known Sabbath Alarm system that can be activated and deactivated during the Sabbath developed by Bet Halevi Systems Ltd. is disclosed in website http://www.shabbat-alarm-.com/, downloaded on May 10, 2010 and incorporated by reference in its entirety. Activation and deactivation is controlled with an electronic circuit that sends an infrared beam from one side to an opposite side every 7 seconds for less than 1 thousandth of a second. The beam and the interval, together form a cycle. As long as the beam reaches the opposite side, activation of the alarm is prevented. If the beam is prevented from reaching the opposite side for 3 consecutive cycles, the alarm is activated. According to the Jewish custom of on work on the Sabbath and Holy Days, the act of obstructing the beam is neither a direct or indirect act of lighting and is therefore permissible on the Sabbath and Holy days to a certain extent.

This Sabbath alarm is permissible to use in cases when a person is concerned for his/her personal safety. However if the concern is only to safeguard property, the use of this system is prohibited according the Orthodox Jewish custom of no work on the Sabbath and Holy Days.

Israel Patent No. IL105083, entitled "Device for activation and disconnection of alarm on Shabbat," assigned to Avraham Halevi, the contents of which is incorporated by reference in its entirety, describes a Sabbath switch on the alarm control unit that can be used to cause activation or deactivation of an alarm system during the Sabbath and Holy Days by closing or opening a user controlled Sabbath switch or preventing activation of a weak relay (if used instead of a switch) by use of a magnet while it is disconnected from the current. After a delay, the device will automatically connect to current, and the device itself will automatically cause activation or deactivation by way of an oscillator that creates contact between the connected relay to the output of the oscillator for a short period of longer intervals that is preset prior to the Sabbath or the Holy day. It is disclosed that the user controlled Sabbath switch can be replaced by various switches or relays such as magnetic switches, mercury switches and photo-electric switches. Such a system as described in IL105083 is also only permissible for use in cases when a person is concerned for his/her personal safety.

U.S. Pat. No. 6,078,256 entitled "Dead-bolt lock monitoring unit and system," the contents of which is incorporated by reference in its entirety, describes a dead-bolt receptacle unit including an optical dead-bolt detecting unit formed in the receptacle to detect a presence of the dead-bolt cylinder in a receiving slot of the receptacle unit. It is disclosed that the detecting unit includes an intermittently pulsing light emitting diode and an optical receiver for detecting the presence of the dead-bolt cylinder in the dead-bolt receiving slot. The dead-bolt detecting unit outputs a dead-bolt detecting signal and a central indicator unit receives the dead-bolt detecting signal output and provides an indication of the status of the dead-bolt. Such a system allows an operator to determine the status of a dead-bolt in the home.

UK Patent Application GB2141774, entitled "Key Operating Locking Device," the contents of which is incorporated by reference in its entirety, describes a key-operated locking device for electrically actuated vehicle door locks in which only the correctly cut key will displace a row of tumblers or wards to bring apertures therein into alignment. A light emitter emits a light beam through the apertures as the key is inserted and if alignment is correct the beam is sensed by a light responsive sensor to generate a signal applied in a control circuit to release the door lock and/or operate other equipment.

International Publication No. WO 83/01643 entitled "Security Switch," the contents of which is incorporated by reference in its entirety, describes a security locking switch for controlling actuation of equipment such as enabling authorized use only of a telephone. The disclosed locking switch includes a housing containing a plurality of gates which are individually transversely movable across a passage provided in the housing, an emitter disposed at one end of said passage and a detector disposed at the other end of the passage. Each gate has an aperture that permits passage of the signal emitted by the emitter. When a proper key engages with the gates, the key sets the gates in position so that their apertures are aligned and the signal emitted by the emitter is received by the detector. Actuation of the detector controls operation of the equipment.

SUMMARY OF THE INVENTION

According to an aspect of some embodiments of the present invention there is provided a system and method for providing activation and deactivation of an alarm system and/or other electrical devices in response to a lock mechanism on a door moving into a locked or unlocked state. According to some embodiments of the present invention activation and deactivation is provided in a manner that is permissible for property safeguard as well as human safeguard in compliance with Orthodox Jewish custom of no work on the Sabbath and Holy Days. In some exemplary embodiments, the Sabbath control unit is a retrofit unit for installation and/or integration into commercially-available lock mechanisms. According to some exemplary embodiments, a lock mechanism including a Sabbath control unit is retrofitted onto commercially available doors and door frames.

According to some embodiments of the present invention, the Sabbath control unit includes an optical interrupter switch that is permissible to use for human safeguard in compliance with Orthodox Jewish custom of no work on the Sabbath and Holy Days. According to some embodiments of the present invention, the Sabbath control unit is incorporated in a lock mechanism on the door and controls activation and deactivation of one or more alarm modules as well as other electric device in response to detected movement in a lock mechanism during locking and/or unlocking of the lock mechanism. According to some embodiments of the present invention, activation and deactivation of an alarm system with a Sabbath control unit is permissible for human safeguard as well as for property safeguard in compliance with Orthodox Jewish custom of no work on the Sabbath and Holy Days.

An aspect of some embodiments of the invention provides a lock mechanism for locking a door or the like with a Sabbath control unit, the lock mechanism with a Sabbath control unit comprising a Sabbath control unit comprising an optical device including a light beam emitter and detector spaced apart with a line of sight path between them, the optical device operative to provide output indicating if a light beam emitted by the emitter is received by the detector, and a locking mechanism comprising a moving member operative to be displaced between a locked state position wherein the door is locked and an unlocked state position wherein the door is unlocked, wherein the moving member is operative to block the line of sight path while in the locked state position and to clear the line of site path while in the unlocked state position, and wherein the Sabbath control unit is operative to activate an electronic device in response to output indicating that the light beam emitted by the emitter has not been received by the detector.

Optionally, the optical device is adapted for retrofitted with a lock mechanism.

Optionally, the lock mechanism with Sabbath control unit is adapted for retrofitting on a door and door frame.

Optionally, the light beam is a pulsed light beam emitted at a pre-defined rate.

Optionally, the pre-defined rate is in the order of magnitude of once every seven seconds.

Optionally, the optical device is operative to activate the electronic device in response to output indicating that a predetermined number of pulses of the pulsed light beam have been blocked.

Optionally, the optical device is an optical interrupter switch.

Optionally, the electronic device is activated with a delay.

Optionally, the delay is in the order of magnitude of 90 seconds.

Optionally, the Sabbath control unit is operative to maintain activation of the electronic device until the output indicates that the light beam emitted by the emitter has been received by the detector.

Optionally, the Sabbath control unit is operative to deactivate the electronic device in response to output indicating that the light beam emitted by the emitter has been received by the detector.

Optionally, the lock mechanism includes a static member and the optical device is installed in the static member of the lock mechanism.

Optionally, the static member is a housing of the lock mechanism or a plug of the lock.

Optionally, the moving member is at least one of a pin, a cam, a latch and bolt of the lock mechanism.

Optionally, the moving member includes a through going bore and wherein the bore is aligned with the line of sight path of the optical device while the moving member is in the unlock state position and is displaced from the line of sight path in the lock state position.

Optionally, at least a portion of the moving member is positioned between the emitter and the detector in the lock state position.

Optionally, the light beam is an infrared beam.

Optionally, the electronic device is an alarm system module.

Optionally, the electronic device is an alarm system and wherein the Sabbath control unit is operative activate one or more alarm system modules in response to output from indicating that the lock mechanism is in a lock state and to deactivate one or more alarm system modules in response to output from indicating that the lock mechanism is in an unlock state.

An aspect of some embodiments of the invention provides for a method for activating an electronic device in conjunction with locking of a door or the like, the method comprising providing a lock mechanism for locking a door including a moving member operative to be displaced along a path between a lock state position wherein the door is locked and an unlock state position wherein the door is unlocked, emitting a light beam across the path so that the light beam is blocked by the moving member positioned in the locked state position and is unblocked by the moving member positioned in the unlocked state, detecting the light beam across the path; and activating the electronic device in response to determining that the light beam is blocked by the moving member.

Optionally, an emitter for emitting the light beam and a detector for detecting the light beam is retrofitted into a lock mechanism.

Optionally, the light beam is a pulsed light beam emitted at a pre-defined rate.

Optionally, the pre-defined rate is in the order of magnitude of once every seven seconds.

Optionally, the method comprises activating the electronic device in response to detecting that a pre-determined number of pulses of the pulsed light beam have been blocked.

Optionally, the electronic device is activated with a delay.

Optionally, the delay is in the order of magnitude of 90 seconds.

Optionally, the method comprises maintaining activation of the electronic device until the emitted light beam is detected to be unblocked.

Optionally, the method comprises deactivating the electronic device in response to detecting that the emitted light beam is detected.

Optionally, the moving member is at least one of a pin, a cam, a latch and bolt of a locking mechanism.

Optionally, the light beam is an infrared beam.

Optionally, the electric device is an alarm system module.

Optionally, the lock mechanism is operative to activate on the alarm system module when the lock mechanism is locked and deactivate the alarm system module when the lock is unlocked.

An aspect of some embodiments of the invention provides for a method for controlling activation and deactivation of one or more alarm system modules in response to locking and unlocking a lock mechanism of a door, the method comprising retrofitting a locking mechanism with a optical interrupter switch, wherein the optical interrupter switch is operative to detect position of a moving member of the lock mechanism along a path between a lock state position wherein the door is locked and an unlock state position wherein the door is unlocked, and switching power to one or more alarm system modules from a deactivated state to an activated state in response to detecting a lock state position of the moving member.

Optionally, the switching is initiated after a predefined delay period.

Optionally, the pre-defined delay period is 90 seconds.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DESCRIPTION OF SPECIFIC EMBODIMENTS OF THE INVENTION

Figure 1:
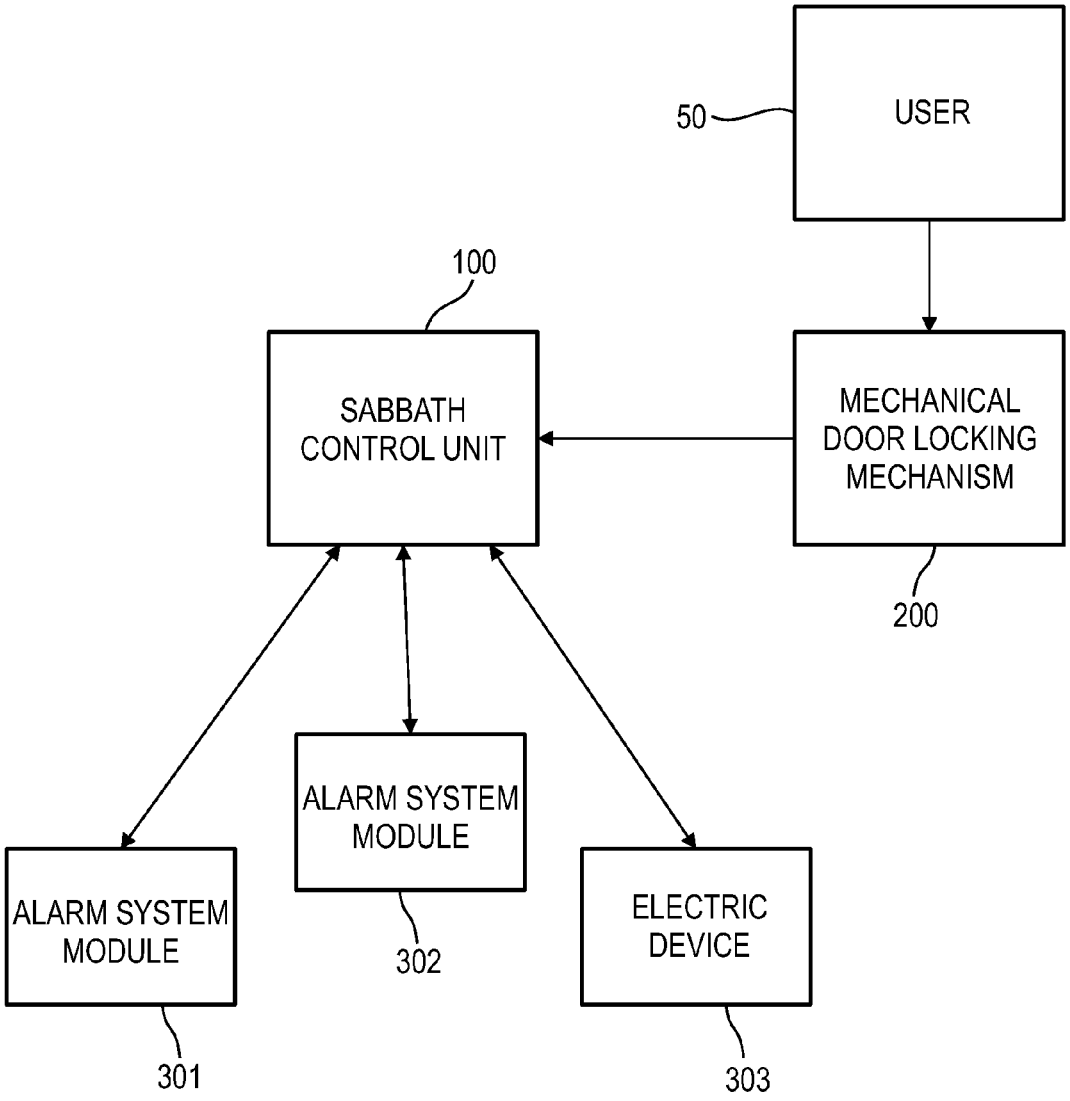
FIG. 1 is a simplified block diagram showing exemplary operation of a lock mechanism with Sabbath control unit in accordance with some embodiments of the present invention.

The present invention, in some embodiments thereof, relates to a Sabbath control unit for controlling actuation of one or more electrical devices with a door lock mechanism in compliance with Orthodox Jewish custom of no work on the Sabbath and Holy Days and, more particularly, but not exclusively, to a Sabbath control unit for activating and deactivating an alarm system or parts thereof.

Although the Sabbath alarm as described in reference to incorporated disclosure in website http://www.shabbat-alarm.com/ is permissible to be activated and deactivated out of a concern for human safeguard in compliance with Orthodox Jewish custom of no work on the Sabbath and Holy Days, it is not permissible to be activated and deactivated during the Sabbath and Holy Days for use to safeguard property. This makes the use of an alarm system that is predominantly used to safeguard property limited.

The present inventors have found that permission to activate or deactivate an alarm and/or security system for purposes other than human safeguard on the Sabbath and Holy Days, for example to safeguard property can be obtained if the alarm system is indirectly activated or deactivated with a switch similar to a switch described in website http://www-.shabbat-alarm.com/ as a result of performing an action that is permissible on the Sabbath and Holy Days. The present inventors have also found that an alarm system can be adapted for operation on the Sabbath and Holy Days to safeguard property by indirectly activating and deactivating the Sabbath alarm switch when operating a mechanical lock (or other lock permissible for use during the Sabbath and Holy Days) on a door to a premises since unlocking and locking a door with a mechanical lock is a permissible action on the Sabbath and Holy Days.

Typically, occupants activate an alarm system when leaving a premises and deactivate the alarm system upon entering.

The present inventors have found that since activation and deactivation of the alarm system is typically associated with leaving and entering a premises, it is convenient to indirectly activate an alarm system in response to an action (an action permissible on the Sabbath and Holy Days) that is associated with entering and vacating a protected premises, e.g. locking the door. In addition, the present inventors have found that since occupants of a premises often leave the key operated door lock unlocked while occupying the premises and locked when leaving the premises, a locking state of a key operated door look can be a reliable indication for when to activate and deactivate the alarm system. If occupants choose to lock the door while in the premises, a separate deadbolt lock or lock that is only operated from inside the premises (as opposed to the key operated door lock) may typically be used which doesn't affect the state of the switch.

In some exemplary embodiments, the door lock mechanism with a Sabbath control unit automatically activates and deactivates specific sensors of an alarm system for sensing a presence of a person within the premises, e.g. motion sensors and volume detectors in response to locking and unlocking of the door lock mechanism. In some exemplary embodiments, when the lock mechanism is in a locked state, it is assumed that the occupants vacated the premises and the sensors are automatically activated to detect intruders. Alternately, when the lock mechanism is in an unlocked stated, it is assumed that occupants are present in the premises and the sensors are automatically deactivated to avoid setting of the alarms and/or activating the sensors during the Sabbath. Optionally, only sensors positioned in rooms that are intended for entry during the Sabbath are operated in response to locking and/or unlocking the lock mechanism with the Sabbath control unit as described herein, while sensors positioned in rooms that are not intended for entry during the Sabbath, e.g. an office in the home or prayer house are independently operated throughout the entire Sabbath or Holy Day.

In some exemplary embodiments, the lock mechanism with Sabbath control unit activates and/or deactivates sensors used to sense opening of a window providing entry into the premises. Optionally, the lock mechanism with Sabbath control unit is used to operate lighting and/or temperature control systems, e.g. air conditioning, surveillance cameras, fire alarms, electrical appliances, telephones, and timers on the premises. In some exemplary embodiments, the Sabbath control unit is installed on a door of a safe box and activates and deactivates an alarm system securing the safe box in response to locking and unlocking of the safe box door.

According to some embodiments of the present invention, the Sabbath control unit is tethered to a remote electrical device (a device other than the lock itself) that is to be activated and deactivated with the Sabbath control unit, e.g. via the door and/or door frame. Optionally, the Sabbath control unit is tethered to lines in an electric box of the premises and/or an alarm system power box. Optionally, the Sabbath control unit is associated with a wireless transmitter for transmitting control commands to the electric device.

According to some embodiments of the present invention, the Sabbath control unit is a retrofit device for installation into a commercially-available lock mechanism. According to some embodiments of the present invention, a lock mechanism including a Sabbath control unit can be retrofitted on a door to replace similar conventional lock mechanisms without requiring changing the door or the door frame.

Optionally, the lock mechanism with Sabbath control unit is operated with a key, code and/or a magnetic card. Typically, the Sabbath control unit is operated without requiring additional mechanical elements and/or moving parts that may compromise durability and reliability of a device. Additionally, the Sabbath control unit is typically operated without any friction so that wear and tear is reduced and its life is prolonged.

According to some embodiments of the present invention, the lock mechanism with Sabbath control unit activates and deactivates one or more modules of an Alarm system. Optionally more than one lock mechanism with Sabbath control unit is installed on more than one door in a premises, e.g. a house, such as in a front and back door of a premises. Optionally, each Sabbath control unit operates different modules of the alarm system.

According to some embodiments of the present invention, the Sabbath control unit includes an optical interrupter switch adapted to sense locking and/or unlocking of the mechanical lock and activate and/or deactivate a remote electrical device in response to the sensing. According to some embodiments of the present invention, the optical interrupter switch is fixed onto a static element of the lock and positioned so that a moving member of the lock alternately intercepts and clears a line of site between an emitter and detector pair of the optical interrupter switch during operation of the lock (locking and unlocking of the lock). In some exemplary embodiments, the optical interrupter switch is fixed to housing of a lock and a portion of a shaft that operates an associated deadbolt or latch alternately blocks and clears the line of site of the switch. Optionally, the optical interrupter switch is fixed to a latch or cam of the lock mechanism (a moving element). Optionally, a dedicated optical blocking member is fixed on the shaft and the optical blocking member and/or the optical interrupter switch are so aligned so that operation of the lock also operates the switch. Optionally, a through going hole is introduced on the shaft or associated optical blocking member and is aligned with the line of site of the switch in one locking state and displaced from the line of site in another locking state. Alternatively, the optical interrupter switch is positioned on a moving member of the lock, e.g. the shaft and an alternate member is moved with respect to the optical interrupter switch during operation of the lock to alternately intercepts and clears a line of site between an emitter and detector pair of the switch during operation of the lock (locking an unlocking).

According to some embodiments of the present invention, the lock is a pin tumbler lock and the Sabbath control unit is adapted to toggle between activating and deactivating the electric device in response to correct alignment of one or more pins in the tumbler lock. In some embodiments of the present invention, one or more pins in the tumbler lock include a through going hole that is aligned with the line of site of the optical interrupter switch of the Sabbath control unit when a proper key is inserted and displaced from the line of site when no key or an improper key is inserted. In some exemplary embodiments, the pin tumbler lock is part of a double cylinder lock and the Sabbath control unit is only included in the cylinder lock operated from outside the premises. In this manner, an occupant can lock the door from the inside without activating the alarm system with the alarm. Optionally, a Sabbath control unit is included in each of the cylinders of the double cylinder lock and such that the Sabbath control units separately operate different parts of the alarm system.

It is noted that unlike the unit disclosed in incorporated U.S. Pat. No. 6,078,256, the optical switch of the Sabbath control unit in the present invention, is integrated into the lock itself as opposed to a receptacle unit of the dead-bolt (as disclosed in incorporated U.S. Pat. No. 6,078,256). The present inventors have found that integrating an optical interrupt switch (or other optical switch) within the lock has numerous advantages. Typically, mechanical locks include one or more mechanisms for preventing tampering with the lock. Since the optical switch in the present invention is incorporated within the lock, the same mechanism used for protection the lock may also protect the switch against tampering. In addition, the present inventors have found that by integrating the optical interrupter switch into the lock, alignment of the optical interrupter switch with an element of the lock can be performed in a manufacturing site as opposed to on-site alignment as is inherently required by the unit disclosed in U.S. Pat. No. 6,078,256. An additional advantage is that, when an optical interrupter switch is used in some embodiments of the present invention, the optical emitter and detector are pre-aligned as opposed to an independent emitter and detector as disclosed in U.S. Pat. No. 6,078,256 that not only requires on-site alignment with the lock mechanism but may also requires on-site alignment between the emitter and detector.

Typically, the distance between an optical emitter and detector of an optical interrupter switch is significantly smaller as compared to distances required in U.S. Pat. No. 6,078,256 to accommodate the dead-bolt. Typically smaller distances between the emitter and detector pair, provides more accurate measurements and lower power consumption requirement. An additional advantage is that environment around an optical interrupter switch within a lock mechanism is less susceptible to errors due to surrounding light conditions as compared to the environment surrounding a dead-bolt receiving slot that is more exposed.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Referring now to the drawings, FIG. 1 illustrates a simplified block diagram showing exemplary operation of a lock mechanism with Sabbath control unit in accordance with some embodiments of the present invention. According to some embodiments of the present invention a Sabbath control unit 100 controls activation and deactivation of one or more alarm system modules 301 and 302 and other electrical device 303 in response to input from a door lock mechanism 200. In some exemplary embodiments, door lock mechanism 200 is a mechanical mechanism including at least one moving part that moves in response to a user 50 locking and/or unlocking the door. It is noted that according to some embodiments of the present invention, a user 50 does not directly operate Sabbath control unit 100.

According to some embodiments of the present invention, Sabbath control unit 100 senses movement of at least one element in the door lock mechanism and activates and deactivates one or more of alarm system modules 301, 302 and other electrical device 303 in response to the sensed movement. According to some embodiments of the present invention, the Sabbath control unit includes a switch that is permissible for use in cases when a person is concerned for his/her personal safety in accordance with Orthodox Jewish custom of no work on the Sabbath and Holy Days. Optionally the switch is an optical interrupter switch. According to some embodiments of the present invention the optical interrupter switch is integrated with the lock mechanism so movement of an element in the door lock mechanism (associated with locking and unlocking) alternatively blocks and unblocks a line of sight of the optical interrupter switch.

Figure 2A:
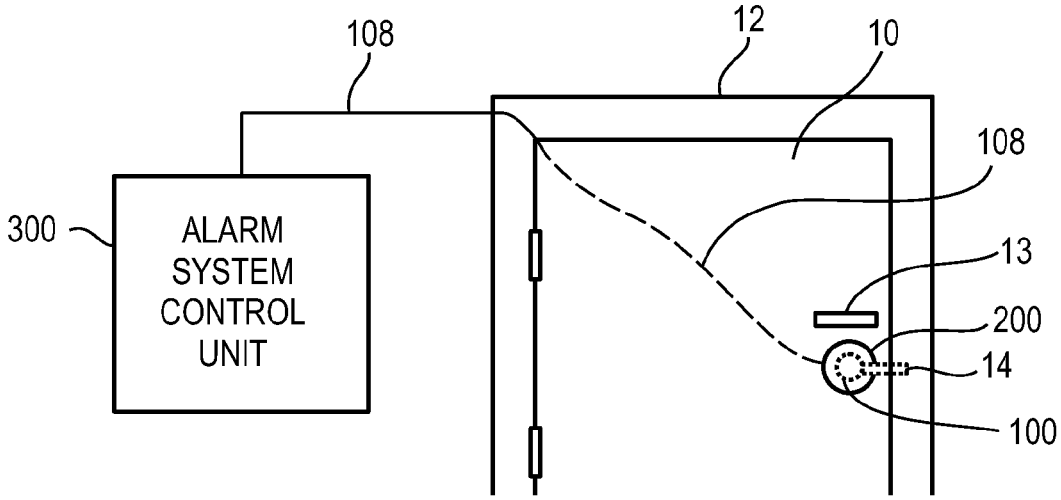
FIGS. 2A and 2B are two simplified schematic views of a lock mechanism with a Sabbath control unit retrofitted on a door in accordance with some embodiments of the present invention.
Figure 2B:
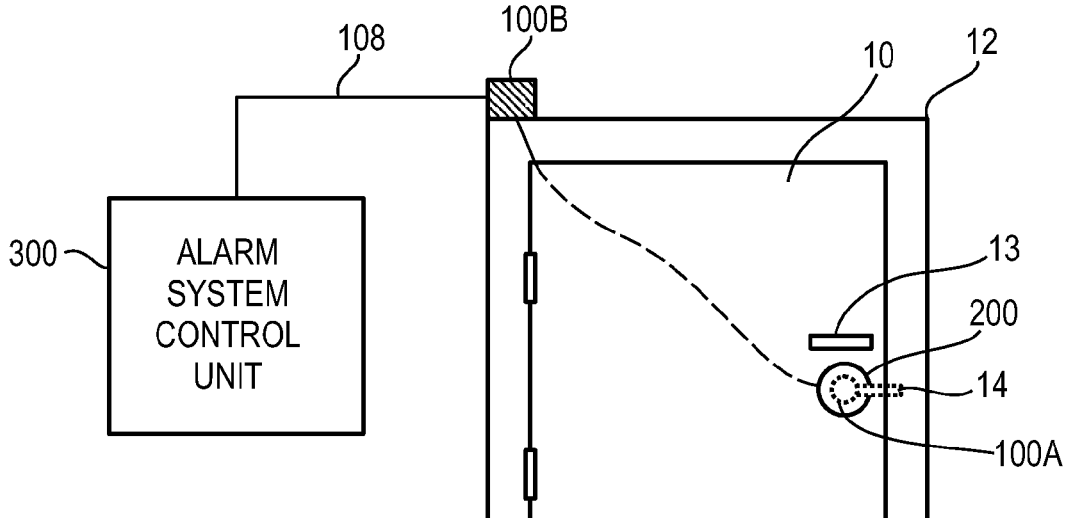

Reference is now made to FIGS. 2A and 2B showing two simplified schematic views of a lock mechanism with a Sabbath control unit retrofitted on a door in accordance with some embodiments of the present invention. According to some embodiments of the present invention, a Sabbath control unit 100 with lock mechanism 200 is installed in a door 10 with door frame 12 and door handle and/or door knob 13. Typically, a mechanical mechanism in the door lock moves a bolt and/or latch 14 in and out of a bore in door frame 12 (and/or a bore in the floor). According to some embodiments, Sabbath control unit 100 is connected by a tethered connection 108 to power units of an alarm system control unit 300 controlling for example alarm system modules 301, 302 and electric devices 303. In some exemplary embodiments, at least a portion of the tethered connection 108 is provided through a hollow in door 10. Optionally, tethered connection 108 is lined around the sides of door 10, e.g. in between door 10 and door frame 12 and/or between door 10 and floor under door 10. Alternatively, communication between Sabbath control unit 100 and remote alarm system control unit 300 is by wireless connection, e.g. blue tooth connection or RF transmission.

Referring now to FIG. 2B, in some exemplary embodiments the Sabbath control unit includes a first portion 100A that is integrated into a lock mechanism 200 of a door 10 and a second portion 100B that is positioned on or near a door frame 12 of the door 10. In some exemplary embodiments, an electrical connection between first portion 100A and second portion 100B is a tethered connection through a hallow of door 10. Optionally, the connection between first portion 100A and second portion 100B is a wireless connection, e.g. blue tooth connection.

In some exemplary embodiments, connection between second portion 100B and alarm system control unit 300 is by tethered connection 108. Optionally, connection between second portion 100B and remote alarm system control unit is by wireless connection, e.g. blue tooth connection or RF transmission.

In some exemplary embodiments, Sabbath control unit 100 and/or 100A are retrofitted onto to lock mechanism 200 and/or lock mechanism with Sabbath control unit 100, 100A and/or 100B are retrofitted onto an existing and/or commercially available door 10.

Figure 3:
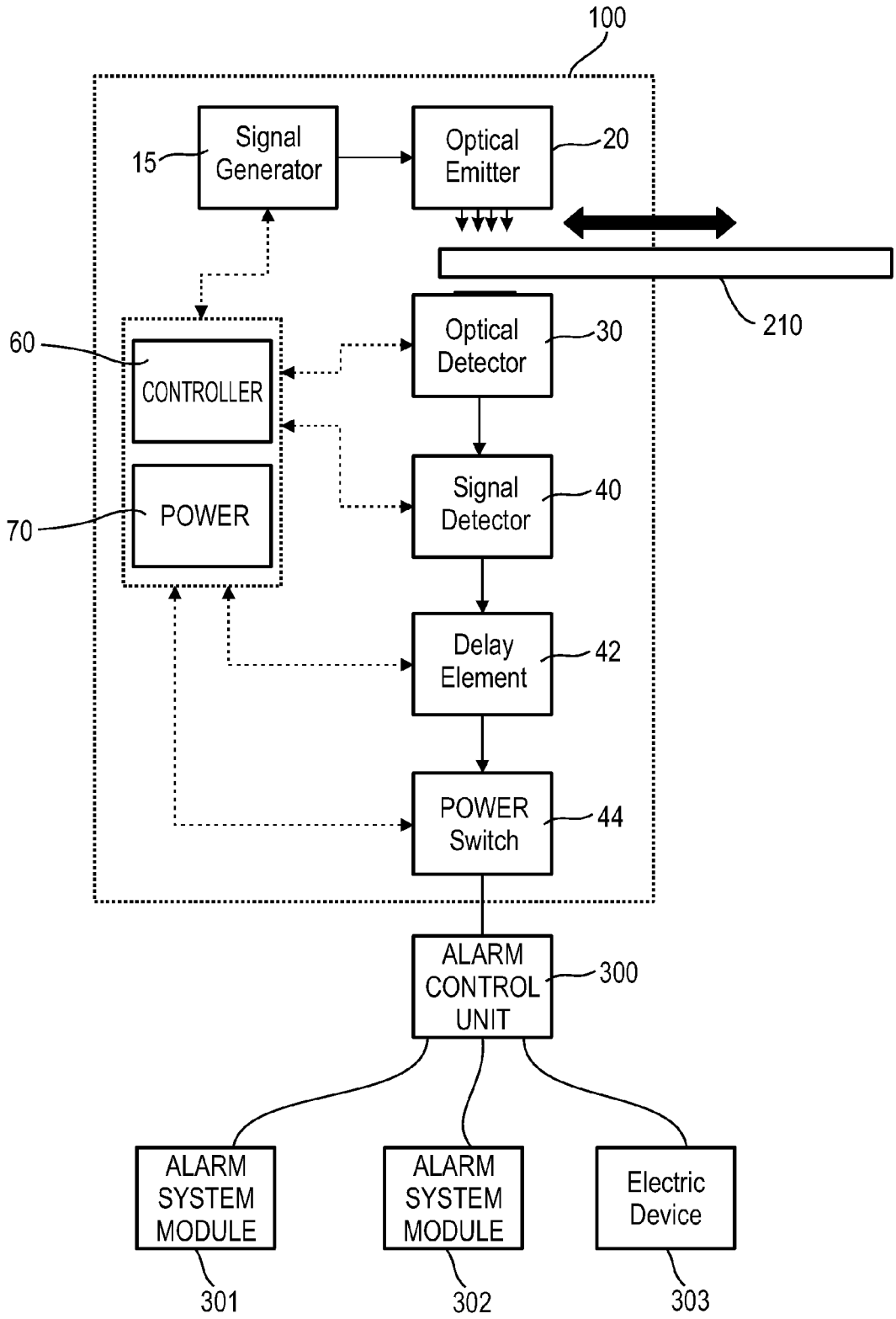
FIG. 3 is a simplified block diagram of the Sabbath control unit in accordance with some embodiments of the present invention.

Reference is now made to FIG. 3 showing a simplified block diagram of the Sabbath control unit in accordance with some embodiments of the present invention. According to some embodiments of the present invention, Sabbath control unit 100 includes an optical emitter 20 that transmits pulses of light toward an optical detector 30. In some exemplary embodiments a signal generator 15 provides a signal, e.g. an oscillating signal for pulsing optical emitter 20. Typically signal generator 15 provides low voltage pulses generating pulses of IR beam in emitter 20. Typically, Sabbath control unit is battery operated.

According to some embodiments of the present invention, optical emitter 20 and optical detector 30 are integrated into the lock mechanism so that an optical blocking member 210 alternatively blocks and clears the line of site between optical emitter 20 and optical detector 30 during operation of the lock mechanism. Typically, optical blocking member 210 is part of the lock mechanism 200 and/or is an element that is fixedly connected to an element of the lock mechanism adapted to fit in a slot between optical emitter 20 and optical detector 30 for alternatively blocking and clearing a line of site between optical emitter 20 and optical detector 30. According to some embodiments of the present invention blocking and clearing of the line of site occurs in response to locking or unlocking of lock mechanism 200. In some exemplary embodiments, blocking and clearing of the line of site occurs in response to insertion of a proper key used to operate lock mechanism 200.

Typically optical detector 30 transmits a first output in response to receiving a pulse, e.g. an expected pulse from optical emitter 20 and transmits a second output in response to not receiving the pulse from optical emitter 20. According to some embodiments of the present invention, a signal detector 40 is operative to detect a pre-defined signal pattern from detector 30 that indicates that one or more alarm system modules (or other electric devices) should be activated or deactivated. In some exemplary embodiments, the pre-defined pattern is a pre-defined time period in which optical detector provides output indicating that no pulse was received and/or a pre-defined number of times that the optical detector consecutively provides output indicating that no pulse was received. Alternatively, the pre-defined pattern is a pre-defined time period or a pre-defined number of times that a pulse emitted by emitter 20 was received by detector 40.

According to some embodiments of the present invention, in response to the signal detector 40 detecting the pre-defined pattern of outputs, a power switch 44 for activating and/or deactivating one or more alarm system modules is switched. Optionally, the power switch includes one or more relays for neutralizing and activating one or more alarm modules, detectors and/or electric devices. According to some embodiments of the present invention, the switch is switched after a delay provided by a delay element, e.g. a delay circuit 42.

According to some embodiments of the present invention controller 60 controls operation of elements of Sabbath control unit 100 and power unit 70. In some exemplary embodiments, power unit 70 includes one or more batteries. Optionally, power is received from a remote power unit, e.g. tethered connection to AC main line or external power unit (battery). Optionally, a portion of the elements of Sabbath control unit 100, e.g. optical emitter 20, optical detector 30 and signal detector 40 are incorporated into the lock mechanism while other portions, e.g. controller 60, power unit 70 and power switch 44 are mounted on the door and/or door frame.

It is noted that although elements 15, 20, 30, 40, 42, 44, 60 and 70 of Sabbath control unit 100 have been described as discrete units these elements and/or their functionality may integrated into one or more lump units. Optionally, at least signal generator 15, optically emitter 20, optical detector 30 and signal detector 40 is packaged as optical interrupter switch. Alternatively each of elements 15, 20, 30, 40, 42, 44, 60 and 70 and/or their functionality may be divided into a plurality of units.

Figure 4A:
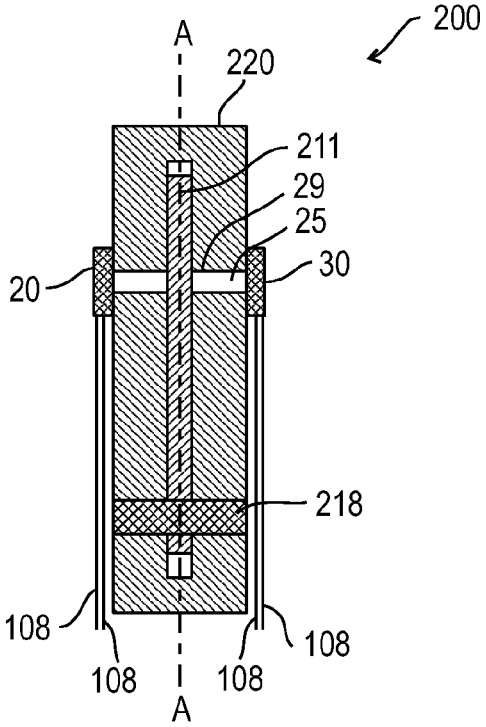
FIGS. 4A, 4B and 4C are simplified schematic top and side views along line A-A of a lock mechanism with Sabbath control unit in accordance with some embodiments of the present invention.
Figure 4B:
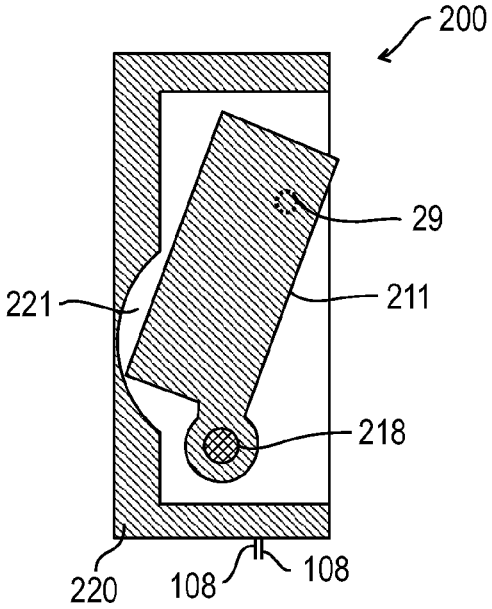
Figure 4C:
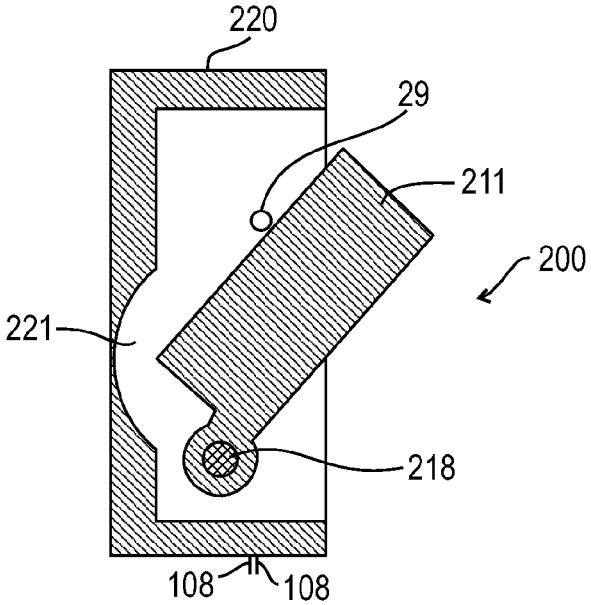
Figure 4D:
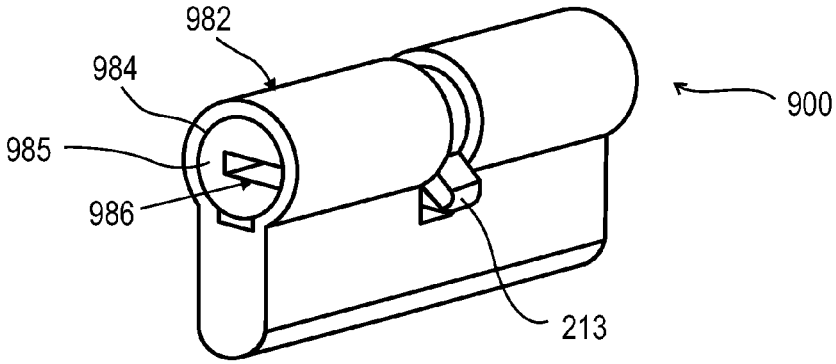
FIG. 4D is a schematic view of a cylinder lock including a Sabbath control unit that operates in response to movement of cylinder cam in accordance with some embodiments of the present invention.

Reference is now made to FIGS. 4A, 4B and 4C showing simplified schematic top and side views along line A-A of a lock mechanism with Sabbath control unit and FIG. 4D showing a cylinder lock including a Sabbath control unit that operates in response to movement of cylinder cam, all in accordance with some embodiments of the present invention. According to some embodiments of the present invention, a lock mechanism 200 includes a static housing 220 and a moving cam 211 that can reciprocate or pivot about a pin 218. According to some embodiments of the present invention optical emitter 20 and optical detector 30 are mounted onto housing 220. An air space 25, e.g. as provided by a through going bore 29 in housing 220 provides a line of sight between optical emitter 20 and optical detector 30. Wires 108 provide tethered communication between optical emitter 20 and optical detector 30 and other elements of Sabbath control unit 100. Optionally, optical emitter 20 and optical detector 30 are integrated into a single unit, e.g. optical interrupter switch.

According to some embodiments of the present invention, when lock mechanism 200 is in a locked state, cam 211 blocks the line of sight blocks the line of sight in air space 25 so that light emitted by emitter 20 is not received by optical detector 30 (FIG. 4B). Optionally, lock mechanism 200 is in a locked state when cam 211 enters into space 221 of housing 220. When the lock is in an unlocked state (FIG. 4C) cam 211 is pivoted about a pin 218 away from air space 25 so that air space 25 is cleared. Once air space 25 is cleared, the line of sight between emitter 20 and detector 30 is established and light emitted by emitter 20 is detected by detector 30.

Referring now to FIG. 4D, optionally, Sabbath control unit 100 is fixed within housing 982 of cylinder lock 900 and in response to a correct key being inserted into keyway 986, shear line 984 is cleared and plug 985 rotates. In some exemplary embodiments, Sabbath control unit 100 detects movement of cam 213 in response to rotation of plug 985 and the alarm system is activated and/or deactivated in response to a detected position of cam 213.

Figure 5A:
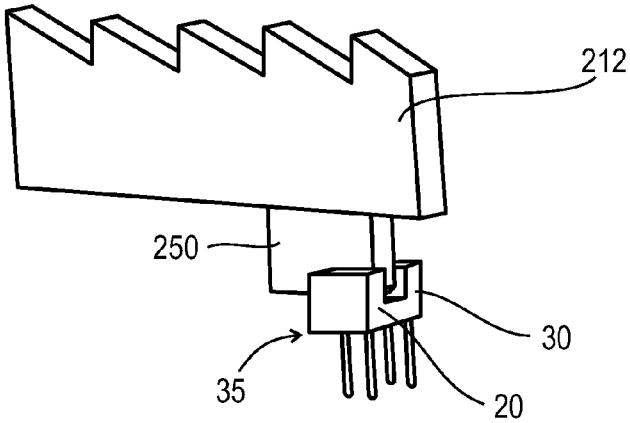
FIGS. 5A and 5B are simplified schematic illustrations of relative positioning between an optical interrupt switch and an optical blocking element fixed to a latch of a lock mechanism in a locked and unlocked state in accordance with some embodiments of the present invention.
Figure 5B:
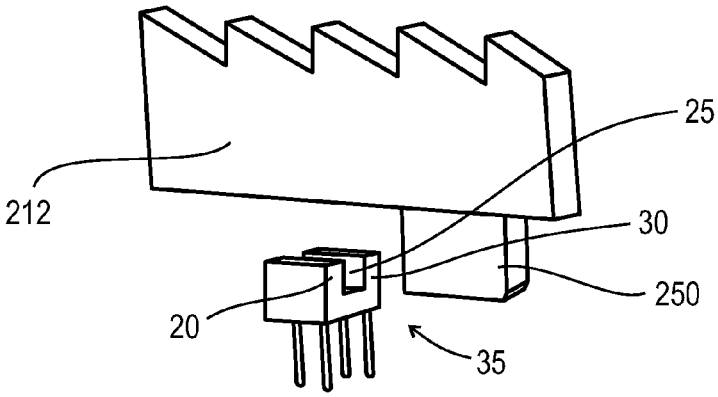

Reference is now made to FIGS. 5A and 5B showing simplified schematic illustrations of relative positioning between an optical interrupt switch and an optical blocking element fixed to a latch of a lock mechanism in a locked and unlocked state in accordance with some embodiments of the present invention. According to some embodiments of the present invention, an optical blocking element 250 fixated on a latch 212 that is designed to fit through air space 25 of optical interrupter switch 35 and to block and unblock a line of site between emitter 20 and detector 30 of switch 35 in response to the latch moving from a lock position to an unlock position. Optical blocking element 250 is positioned within the lock. According to some embodiments of the present invention, optical block element 250 is in the form of a thin plate.

Figure 6A:
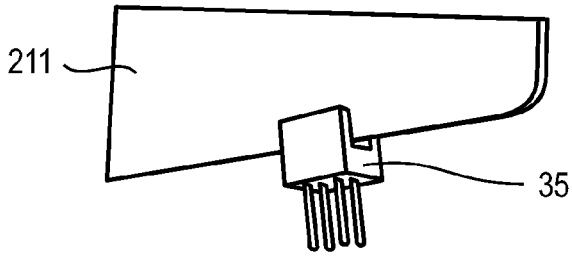
FIGS. 6A and 6B are simplified schematic illustrations of relative positioning between an optical interrupt switch and a through going bore of a latch of a lock mechanism in a locked and unlocked state in accordance with some embodiments of the present invention.
Figure 6B:
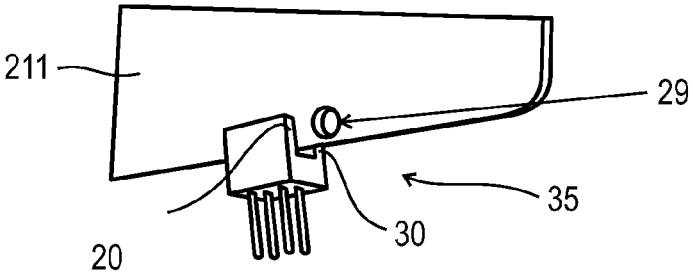

Reference is now made to FIGS. 6A and 6B showing simplified schematic illustrations of relative positioning between an optical interrupt switch and a through going bore of latch of a lock mechanism in a locked and unlocked state in accordance with some embodiments of the present invention. According to some embodiments of the present invention, an optical interrupter switch 35 is fixed onto a static element of a lock mechanism so that an air space 25 between emitter 20 and detector 30 of switch 35 receives a portion of latch 211 without obstructing it movement path as it moves between a locked and unlocked position. According to some embodiments of the present invention, latch 211 includes a through going bore 29. In some exemplary embodiments, emitter detector pair 35 is fixed on the lock mechanism so that it is aligned with through going bore 29 while latch 211 is in a lock state and displaced from through going hole while latch 211 is in an unlock stated. In an unlock state of the lock mechanism, emitter detector pair 35 is aligned with through going bore 29 and light emitted by emitter 20 is received by detector 30. In an unlock state of the lock mechanism, emitter detector pair is displaced from through going bore 29 and light emitted from emitter 20 is blocked from detector 30 by latch 211 so that the light emitted is not received by detector 30. Alternatively, switch 35 is positioned so that air space 25 is displaced from going hole while latch 211 is in a locked state and aligned with through going hole while latch 211 is in an unlocked stated.

Figure 7:
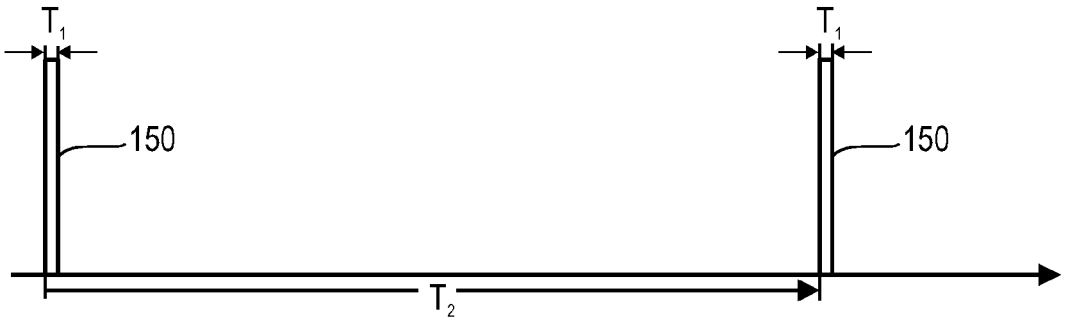
FIG. 7 is a simplified time line of exemplary pulses periodically transmitted by an optical emitter of the Sabbath control unit in accordance with some embodiments of the present invention.

Reference is now made to FIG. 7 showing a simplified time line of exemplary pulses periodically transmitted by an optical emitter of the Sabbath control unit in accordance with some embodiments of the present invention. According to some embodiments of the present invention, emitter 20 is prompted to emit short pulses of light at a defined rate. According to some embodiments of the present invention, emitter 20 emits light in the IR range.

In some exemplary embodiments, a pulse 150 every 5-15 seconds, e.g. 7 seconds ($T_2$=7) is emitted. According to some embodiments of the present invention a duration of the pulse, $T_1$ is significantly shorter than the cycle period, $T_2$. In some exemplary embodiments $T_1$ is less than 1 millisecond as described in reference to incorporated website http://www-.shabbat-alarm.com/. Optionally, $T_1$ is extended to up to 3 seconds. Short pulses over relatively long repeat cycle periods provides a high probability that interruption by a blocking member does not intercept pulse 150 but only prevents future beams from being received by the detector. The relatively long cycle period $T_1$ provides a high possibility that blocking of an air space of the emitter detector pair is completed between pulses. This relationship between $T_1$ and $T_2$ is important in accordance with Orthodox Jewish custom of no work on the Sabbath and Holy Days and is one of the factors that make the Sabbath control unit permissible for use on the Sabbath for concern for personal as well as property safeguard. An advantage in using pulsed emission at a predefined rate as opposed to continuous emission is significantly reduced power consumption. Pulsing with short pulses over relatively long repeat cycle periods increases this advantage.

In some exemplary embodiment, as long as pulse 150 is detected by detector 30 once every cycle ($T_2$) activation of the alarm and/or other electrical devices are prevented. Optionally if the beam does not receive a pulse 150 once every cycle ($T_2$) for a pre-defined number of times, e.g. 3 times, the alarm and/or other electrical devices are activated.

Figure 8:
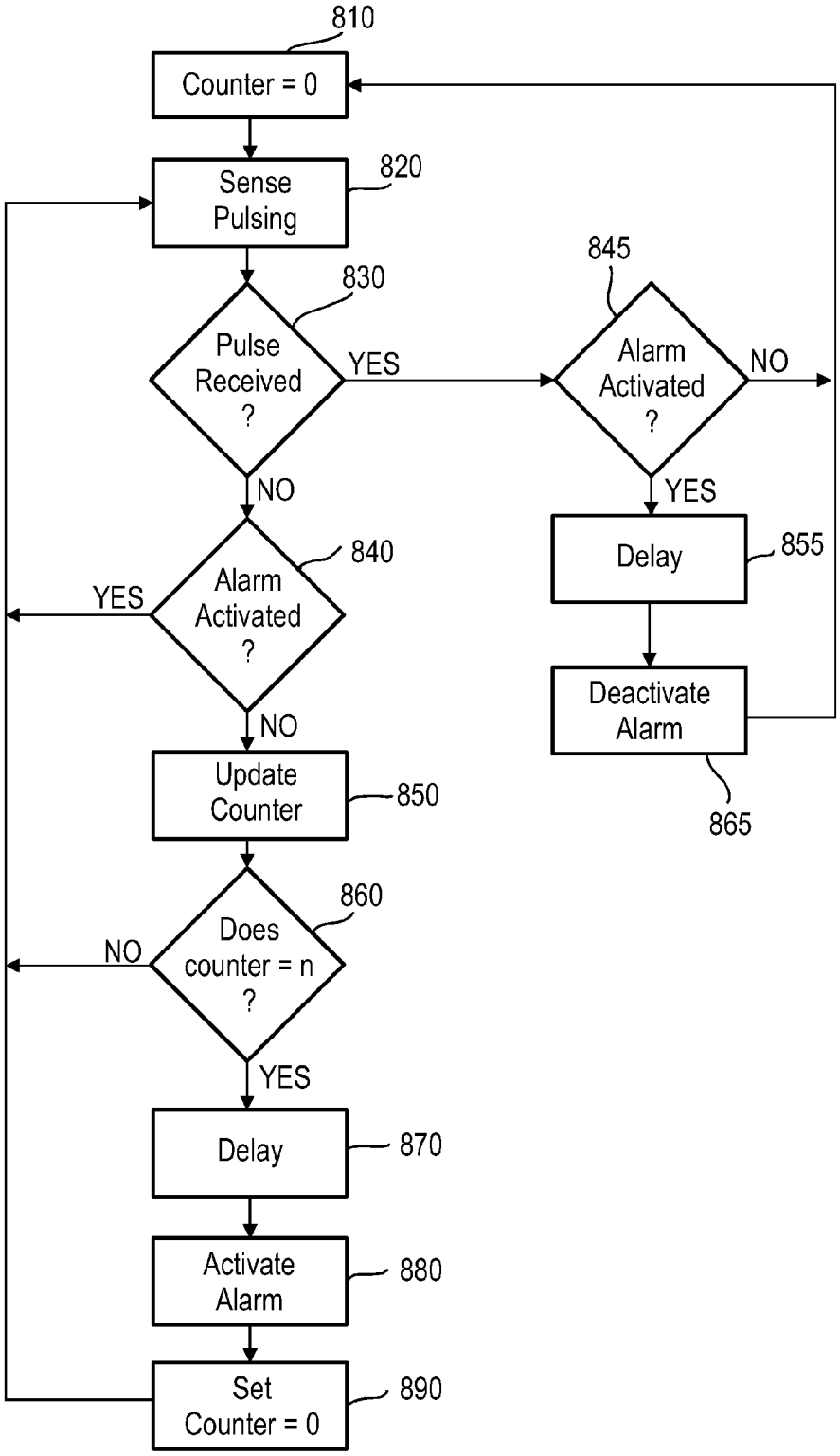
FIG. 8 is an exemplary flow chart of a method for controlling activation and deactivation of an alarm system and other devices with a Sabbath control unit in accordance with some embodiments of the present invention.

Reference is now made to FIG. 8 showing an exemplary flow chart of a method for controlling activation and deactivation of an alarm system and other devices with a Sabbath control unit in accordance with some embodiments of the present invention. According to some embodiments of the present invention, at the onset of operation, a counter is set to zero (block 810) and signal detector 40 begins to detects output from detector 30 (block 820). Typically pulsing of emitter 20 occurs at pre-defined rate known to signal detector 40 and signal detector 40 detects output from detector 30 during a time period when a pulse is expected. In some exemplary embodiments, when the time period has elapsed it is determined if a pulse has been received (block 830). In the case that a pulse has been received and designated alarm modules 301, 302 and/or electrical devices 303 are currently activated (block 845), a command is initiated to deactivate designated alarm modules and electric devices (block 865) after a predefined delay (block 855), e.g. 3 seconds to 2 minute delay.

According to some embodiments of the present invention, if it is determined that a pulse has not been received, e.g. has been blocked, the operational state (or power state) of alarm modules 301, 302 and/or electrical devices 303 are determined (block 840). In the case that alarm modules 301, 302 and/or electrical devices 303 are currently activated, signal detector 40 continues to detect output from detector 30. In the case when one or more associated alarm modules 301 and 302 (or other associated electrical devices 303) are determined to be deactivated, a counter begins to count the number of blocked pulses, e.g. consecutively blocked pulses (block 850). In some exemplary embodiments, when it is determined that a pre-determined number of pulses have been blocked, e.g. 3-5 pulses one or more alarm modules 301, 302 and electrical devices 303 are activated, e.g. powered (block 880) after a pre-defined delay, e.g. 3 seconds to 2 minutes. Optionally a delay is not required for activating and deactivating alarm modules 301, 302 and/or electrical devices 303. Optionally, delays are selectively imposed on activation and/or deactivation of specific alarm modules and/or electric devices controlled by the Sabbath control unit.

According to some embodiments of the present invention, the Sabbath alarm system additionally includes sensors to detect any tampering with the lock mechanism and/or installed Sabbath control unit and in response activates the alarm modules.

Figure 9:
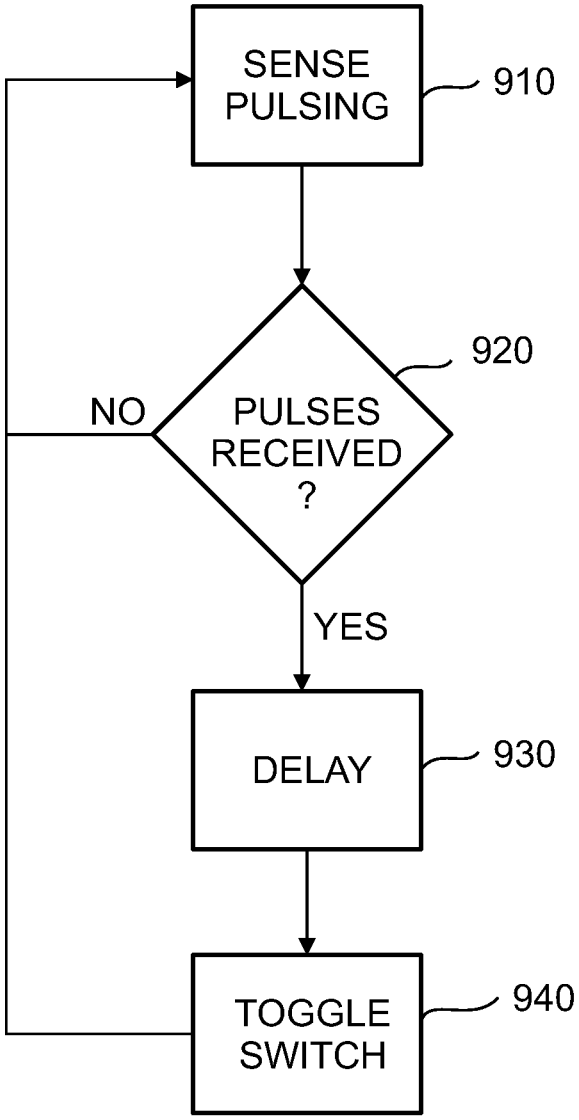
FIG. 9 is an exemplary flow chart of a method for controlling activation and deactivation of an alarm system with a Sabbath control unit operative to sense alignment of one or more locking pins of the cylinder lock in accordance with some embodiments of the present invention.

Reference is now made to FIG. 9 showing an exemplary flow chart of a method for controlling activation and deactivation of an alarm system with a Sabbath control unit operative to sense alignment of one or more locking pins of the cylinder lock in accordance with some embodiments of the present invention. According to some embodiments of the present invention a Sabbath control unit senses pulses received by a detector of an optical interrupt switch of the Sabbath control unit (block 910). Typically, repeat rate of pulsing is known and the detector determines if an expected pulse was received (block 920). According to some embodiments of the present invention, in response to determining that a pulse was received, a toggle switch that toggles between activating and deactivating one or more alarm modules and/or electric devices is switched (block 940). Optionally, switching between activation and deactivation is initiated after a predefined delay (block 930).

Figure 10A:
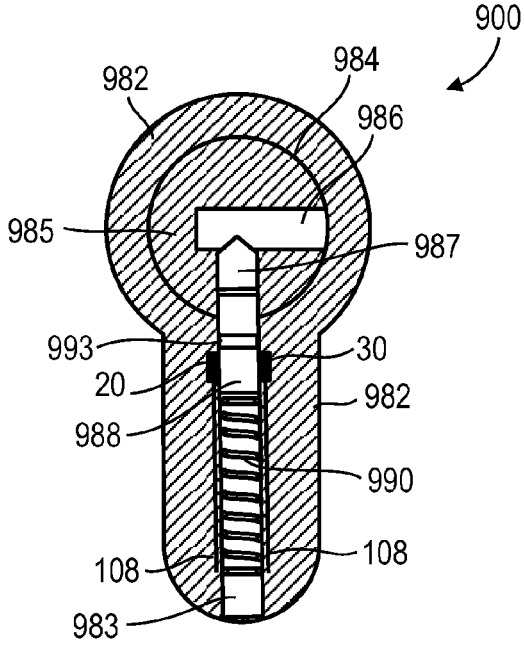
FIGS. 10A and 10B are simplified schematic illustrations of a cylinder lock including a Sabbath control unit operative to sense alignment of one or more locking pins of the cylinder lock in accordance with some embodiments of the present invention.
Figure 10B:
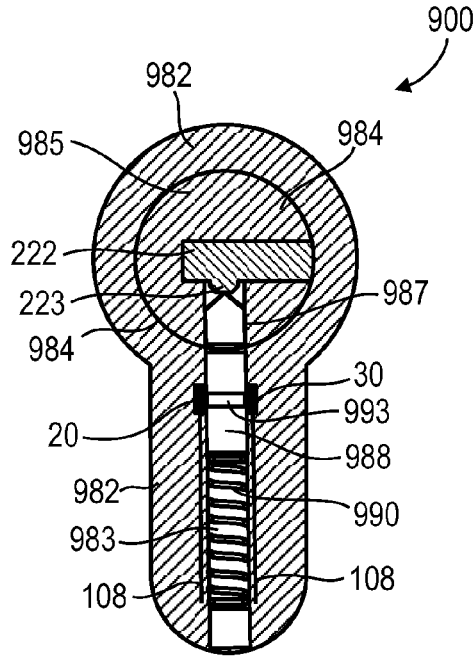
Figure 10C:
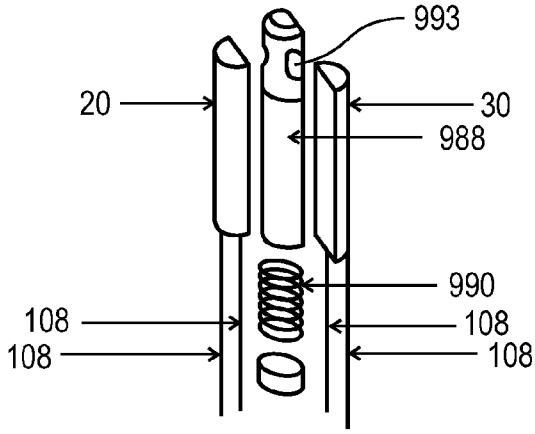
FIG. 10C is a simplified schematic illustration of an optical emitter and optical detector adapted to detected positioning of a locking pin in accordance with some embodiments of the present invention.

Reference is now made to FIGS. 10A and 10B showing simplified schematic illustrations of a cylinder lock including a Sabbath control unit operative to sense alignment of one or more locking pins of the cylinder lock and FIG. 10C showing alignment of one or more locking pins with an optical emitter and detector in accordance with some embodiments of the present invention. Typically, cylinder lock 900 includes a housing 982 and rotatable plug 985 with a cam 991 that can be rotated with respect to housing 982 when a proper key is inserted in a keyway 986. One or more pins 988, e.g. spring loaded pins (only one is shown for simplicity) in a bore(s) 983 of housing 982 is configured to traverse a shear line 984 between housing 982 and plug 985 while no key is inserted and thereby prevent rotation of plug 985 and cam 991. When a proper key is inserted, features in the proper key align pins 988 so that the shear line is cleared and plug 985 and cam 991 can be rotated, e.g. to a locked or unlocked position. It is noted that although a key with a spring loaded pin is described, other keys with other types of pins, elevations or cuts that communicate with locking pins of the lock can also be used with the Sabbath control unit in a similar manner.

According to some embodiments of the present invention, an optical interrupter switch 35 of Sabbath control unit is fixedly positioned in bore 983 to detect positioning of pin 988. According to some embodiments of the present invention, pin 988 includes a through going hole 993 that is aligned with a line of sight of optical interrupter switch 35 while a proper key is inserted so that pulses transmitted by an emitter 20 is received by detector 30. In some exemplary embodiments, once the proper key is removed, pin 988 is displaced so that through going bore 993 is no longer aligned with a line of sight of optical interrupter switch 35 and pin 988 blocks light emitted by emitter 20 (detector 30 does not receive the emitted light pulses).

According to some embodiments of the present invention, Sabbath control unit toggles activation and deactivation of alarm system modules 301 and 302 and electrical devices in response to detecting an event where pulses are received by detector 30 (in response to insertion of a prior key).

It is noted that although in most of the embodiments of the present invention it has been described that the alarm system modules and other electric devices are activated in response to blocking of the emitted pulses and deactivated in response to clearing line of sight between the emitter and detector, it is clear that these examples are not limiting and that the opposite relationship may exist where the alarm system modules and other electric devices are deactivated in response to blocking of the emitted pulses and activated in response to clearing line of sight between the emitter and detector.

It is also noted that although only two alarm system modules and one electrical device have been shown in the drawing, the Sabbath alarm system can be connected to an unlimited number of modules and/or associated power units for activating and deactivating different modules and electrical devices.

It is also noted that while when a plurality of alarm modules and/or devices are connected to the Sabbath control unit, unlocking and/or locking of the locking mechanism may result in activation of some of the modules and/or devices and deactivation of other modules and/or devices as predefined by the Sabbath control unit and connection thereto.

The terms "comprises", "comprising", "includes", "including", "having" and their conjugates mean "including but not limited to".

The term "consisting of" means "including and limited to".

The term "consisting essentially of" means that the composition, method or structure may include additional ingredients, steps and/or parts, but only if the additional ingredients, steps and/or parts do not materially alter the basic and novel characteristics of the claimed composition, method or structure.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Although the invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

All publications, patents and patent applications mentioned in this specification are herein incorporated in their entirety by reference into the specification, to the same extent as if each individual publication, patent or patent application was specifically and individually indicated to be incorporated herein by reference. In addition, citation or identification of any reference in this application shall not be construed as an admission that such reference is available as prior art to the present invention. To the extent that section headings are used, they should not be construed as necessarily limiting.

What is claimed is:

1. A lock mechanism for locking a door or window with a Sabbath control unit, the lock mechanism with a Sabbath control unit comprising:

a Sabbath control unit comprising an optical device including a light beam emitter and detector spaced apart with a line of sight path between them, the optical device operative to provide output indicating if a light beam emitted by the emitter is received by the detector, and a locking mechanism comprising a moving member operative to be displaced between a locked state position wherein the door is locked and an unlocked state position wherein the door is unlocked;

wherein the moving member is operative to block the line of sight path while in the locked state position and to clear the line of site path while in the unlocked state position, and wherein the Sabbath control unit is operative to activate an electronic device in response to output indicating that the light beam emitted by the emitter has not been received by the detector.

2. The lock mechanism with Sabbath control unit according to claim 1, wherein the optical device is adapted for retrofitted with a lock mechanism.

3. The lock mechanism with Sabbath control unit according to claim 1, wherein the lock mechanism with Sabbath control unit is adapted for retrofitting on a door and door frame.

4. The lock mechanism with Sabbath control unit according to claim 1, wherein the light beam is a pulsed light beam emitted at a pre-defined rate.

5. The lock mechanism with Sabbath control unit according to claim 4, wherein the pre-defined rate is in an order of magnitude of once every seven seconds.

6. The lock mechanism with Sabbath control unit according to claim 4, wherein the optical device is operative to activate the electronic device in response to output indicating that a pre-determined number of pulses of the pulsed light beam have been blocked.

7. The lock mechanism with Sabbath control unit according to claim 1, wherein the optical device is an optical interrupter switch.

8. The lock mechanism with Sabbath control unit according to claim 1, wherein the electronic device is activated with a delay.

9. The lock mechanism with Sabbath control unit according to claim 8, wherein the delay is in the order of magnitude of 90 seconds.

10. The lock mechanism with Sabbath control unit according to claim 1, wherein the Sabbath control unit is operative to maintain activation of the electronic device until the output indicates that the light beam emitted by the emitter has been received by the detector.

11. The lock mechanism with Sabbath control unit according to claim 1, wherein the Sabbath control unit is operative to deactivate the electronic device in response to output indicating that the light beam emitted by the emitter has been received by the detector.

12. The lock mechanism with Sabbath control unit according to claim 1, wherein the lock mechanism includes a static member and the optical device is installed in the static member of the lock mechanism.

13. The lock mechanism with Sabbath control unit according to claim 12, wherein the static member is a housing of the lock mechanism or a plug of the lock.

14. The lock mechanism with Sabbath control unit according to claim 1, wherein the moving member is at least one of a pin, a cam, a latch and bolt of the lock mechanism.

15. The lock mechanism with Sabbath control unit according to claim 1, wherein the moving member includes a through going bore and wherein the bore is aligned with the line of sight path of the optical device while the moving member is in the unlock state position and is displaced from the line of sight path in the lock state position.

16. The lock mechanism with Sabbath control unit according to claim 1, wherein at least a portion of the moving member is positioned between the emitter and the detector in the lock state position.

17. The lock mechanism with Sabbath control unit according to claim 1, wherein the light beam is an infrared beam.

18. The lock mechanism with Sabbath control unit according to claim 1, wherein the electronic device is an alarm system module.

19. The lock mechanism with Sabbath control unit according to claim 1, wherein the electronic device is an alarm system and wherein the Sabbath control unit is operative activate one or more alarm system modules in response to output from indicating that the lock mechanism is in a lock state and to deactivate one or more alarm system modules in response to output from indicating that the lock mechanism is in an unlock state.

20. A method for activating an electronic device in conjunction with locking of a door or window, the method comprising:

providing a lock mechanism for locking a door including a moving member operative to be displaced along a path between a lock state position wherein the door is locked and an unlock state position wherein the door is unlocked;

emitting a light beam across the path so that the light beam is blocked by the moving member positioned in the locked state position and is unblocked by the moving member positioned in the unlocked state;

detecting the light beam across the path; and activating the electronic device in response to determining that the light beam is blocked by the moving member.

21. The method according to claim 20, wherein an emitter for emitting the light beam and a detector for detecting the light beam is retrofitted into a lock mechanism.

22. The method according to claim 20, wherein the light beam is a pulsed light beam emitted at a pre-defined rate.

23. The method according to claim 22, wherein the predefined rate is in an order of magnitude of once every seven seconds.

24. The method according to claim 22, comprising activating the electronic device in response to detecting that a predetermined number of pulses of the pulsed light beam have been blocked.

25. The method according to claim 20, wherein the electronic device is activated with a delay.

26. The method according to claim 25, wherein the delay is in the order of magnitude of 90 seconds.

27. The method according to claim 20, comprising maintaining activation of the electronic device until the emitted light beam is detected to be unblocked.

28. The method according to claim 20, comprising deactivating the electronic device in response to detecting that the emitted light beam is detected.

29. The method according to claim 20, wherein the moving member is at least one of a pin, a cam, a latch and bolt of a locking mechanism.

30. The method according to claim 20, wherein the light beam is an infrared beam.

31. The method according to claim 20, wherein the electric device is an alarm system module.

32. The method according to claim 31, wherein the lock mechanism is operative to activate on the alarm system module when the lock mechanism is locked and deactivate the alarm system module when the lock is unlocked.

33. A method for controlling activation and deactivation of one or more alarm system modules in response to locking and unlocking a lock mechanism of a door, the method comprising:

retrofitting a locking mechanism with a optical interrupter switch, wherein the optical interrupter switch is operative to detect position of a moving member of the lock mechanism along a path between a lock state position wherein the door is locked and an unlock state position wherein the door is unlocked; and switching power to one or more alarm system modules from a deactivated state to an activated state in response to detecting a lock state position of the moving member.

34. The method according to claim 33 wherein the switching is initiated after a predefined delay period.

35. The method according to claim 34, wherein the predefined delay period is 90 seconds.

* * * * *